United States Patent [19]

Vezirian

[11] Patent Number: 4,854,368

[45] Date of Patent: Aug. 8, 1989

[54] LOST FOAM CASTING METHOD

[76] Inventor: Edward Vezirian, P.O. Box 2255, Vista, Calif. 92083

[21] Appl. No.: 290,522

[22] Filed: Dec. 27, 1988

[51] Int. Cl.[4] ..... B22C 7/02; B22C 9/04

[52] U.S. Cl. ..... 164/34; 164/61

[58] Field of Search ..... 164/34, 35, 61

[56] References Cited

U.S. PATENT DOCUMENTS

| | | | |
|---|---|---|---|
| 3,259,949 | 7/1966 | Moore | 164/34 |
| 4,499,940 | 2/1985 | Hall | 164/34 X |

FOREIGN PATENT DOCUMENTS

| | | | |
|---|---|---|---|
| 59-73146 | 4/1984 | Japan | 164/34 |
| 62-3850 | 1/1987 | Japan | 164/34 |
| 336078 | 5/1972 | U.S.S.R. | 164/34 |
| 1210955 | 2/1986 | U.S.S.R. | 164/34 |
| 2148760A | 6/1985 | United Kingdom | 164/34 |

*Primary Examiner*—Nicholas P. Godici
*Assistant Examiner*—J. Reed Batten, Jr.

[57] ABSTRACT

In a lost foam investment casting process, the foam pattern is vacuum evaporated from the mold prior to pouring the metal.

11 Claims, No Drawings

LOST FOAM CASTING METHOD

FIELD OF THE INVENTION

This invention pertains to the lost foam investment casting process.

More specifically, this invention is directed to a method whereby such a process may be used to commercially produce precision castings of metals which are highly purified or which must be protected from carbon or other byproducts of the pyrolysis of a foam pattern.

BACKGROUND OF THE INVENTION

Lost wax investment casting was practiced in the days of Julius Caesar, but it is not known how or when the art was first developed. Jewelers have used the process through the past twenty one centuries, to cast small items of precious metals. In the last half century commercial foundries have turned to investment casting as a viable manufacturing process. Complex structural members of jet engines measuring several feet across are cast in exotic alloys in modern foundries.

A pattern, being a sacrificial model of the piece-part, is produced of wax, or a synthetic wax which is a plastic compound. In production, this pattern is usually produced by injection molding. If cores are required by the design of the part, then the cores are formed first using a wax laced with, for example, sodium bicarbonate. The pattern wax is then formed about the finished cores. Subsequently, the composite wax is submerged in a dilute acid bath which reacts with the additive in the core wax causing the cores to disintegrate without damage to the pattern. Gates and risers of wax, and a suitable pouring cup, are then attached using a hot wax compound which acts as a thermal-set glue. Smaller parts are generally clustered under one pouring cup and main riser, the assembly being known as a "tree".

The finished cluster is then "invested", that is to say that it is encased within a refractory mold. There are two types of refractory molds in common use, the solid mold, and the shell mold. There are also a number of less common systems in use.

Primary investment slurry is generally composed of very fine zircon sand along with a binder of colloidal silica or of hydrolized ethyl silicate. Other binders sometimes used include gypsum plaster, and potassium or sodium silicate.

Solid mold investment involves a single dip of the pattern cluster in refractory slurry, exclusive of the top of the pouring cup. The coating is allowed to dry. The cluster is positioned in a flask which is then filled with slurry and dried. Subsequently the entire flask is dewaxed, fired, and poured.

A ceramic shell investment is produced by dipping the pattern into a refractory slurry, then stuccoing the wet coating with sand, and allowing the coating to dry slowly. This sequence is repeated a number of times, the first dip or two using a slurry of zircon sand, and a zircon stucco. Subsequent backup slurries and stuccos generally rely on coarser refractories of fused silica or aluminosilicate to provide a denser and stronger shell.

The mold is then placed in a steam autoclave, being positioned with the pouring cup downward so that melted wax can completely drain from the mold. Steam provides the heat to melt the wax pattern, and pressure against the outside of the mold to support the mold against cracking as the heated wax within tends to expand.

The empty mold is transferred to a ceramic film where it is heated for several hours to eliminate all traces of moisture, and all traces of residual wax. The temperature is increased for another period, generally two or three hours, to vitrify the ceramic, making it very hard and strong, and incandescently hot.

The metal is melted, then the incandescent mold is removed from the kiln and placed on a bed of sand and immediately filled with metal. The metal quickly freezes, and as the solid metal cools the shrinkage partially breaks the mold. When cooled, the remaining investment is broken away, the gates and risers are cut off, and the finished casting is cleaned.

The investment casting process is a precision casting process. If the pattern is well made, no flash or parting lines are produced, and therefore need not be removed. Drafts are not usually required in investment casting, unlike sand casting which requires generous drafts. Investment casting is, however, a more expensive and labor intensive process.

"Full mold casting", or "Evaporative pattern casting" is a newly developing process based on a pattern formed of light plastic foam instead of wax. Most commonly, the pattern is made of expanded-bead polystyrene. Cores are not used. Instead, cavities are commonly formed by the use of "drawbacks", a trick practiced in the aluminum tooling used to produce the pattern. Another option is to make the pattern of multiple pieces which are joined together by the use of adhesive, leaving well formed cavities in between.

The use of polymeric foam as an evaporative pattern was first taught by Shroyer in U.S. Pat. No. 2,830,343. The use of an evaporative foam pattern in conjunction with unbonded sand was taught by T. R. Smith in U.S. Pat. No. 3,157,924.

The prepared pattern cluster is dipped, or otherwise coated, with a single coating of refractory slurry. The proper selection of refractory slurry is critical to the success of this casting process. The lengthy development of satisfactory refractory slurries kept the process from practical commercial use for years, consequently such refractory slurries are proprietary to their developers. The finished coating must be strong enough to support the internal pressure, weight, and erosive forces of the liquid metal; refractory enough to withstand the high temperature and thermal shock of the pour; must be gas permeable enough to vent the vapors from the evaporating pattern; and must be used "unfired", since firing would destroy the pattern.

The coated pattern cluster is dried in a low temperature, well ventilated, kiln (135° F./145° F. for about three hours, or until dry. The dried and coated pattern cluster is then positioned within a flask and the flask is packed with course dry unbonded foundry sand, and poured. The pattern fully occupies the mold at the start of pouring, hence the term full mold casting. At the liquid metal/pattern interface the pattern experiences a combination of melting, vaporization, combustion, and probably, sublimation. The voluminous byproducts of this process are vented through the permeable pattern coating and through the course sand beyond. The destruction of the pattern progresses at a rate dependent upon the pouring temperature, metalstatic head, and permeability of the composite mold. In the full mold casting process, flow of metal into the mold is controlled primarily by the permeability of the mold instead of the size of the ingates.

In other casting processes, the metal flows into the mold at a rate controlled by ingates and the risering system. In "full mold casting" the ingates are made as large as possible without interfering with the ordered destruction of the pattern as described above. The enlarged ingates are depended upon to lend strength to the pattern cluster during coating and handling. The plastic foam comprising the pattern is made a minimum density to reduce the volume of waste byproducts formed by pyrolyzation of the pattern. The foam at a typical density of 1.0 to 2.0 pounds per cubic feet, lacks the strength found in a wax pattern. At 1.0 pound density, the byproducts of decomposition are easiest to handle, but the pattern is more easily damaged and has lower dimensional stability. At 2.0 pound density, the strength and dimensional stability of the pattern are greatest, however so are the problems of handling the byproducts of decomposition. The large volumes of vapors have been known to fluidize the sand in the flask allowing the mold to burst and collapse at that unsupported location.

Three types of defect are peculiar to ferrous full mold casting. Metal flows coming from opposing directions may carry carbonaceous surface films which prevent the two masses from fusing properly thus producing a "lap" defect. Also, in heavier sections, masses of foam pattern may be trapped by freezing metal, and, being cut off from venting, show up as massive carbon inclusions or gas pockets in the finished casting. Part of the pattern which burns produces carbon soot which cannot vent through the pattern coating. This soot collects on certain surfaces of the casting forming pits and lustrous hard carbon deposits.

One of the economic advantages of the full mold casting system is that the unbonded sand may be reused several times with little or no recovery processing. Some of the decomposition byproducts do condense within the sand, cooling to solid organic contaminants affecting the reusability of the sand, and limiting the number of times the sand may safely be reused.

In the complex decomposition process, a number of noxious, toxic, or cancer causing compounds are produced which are of environmental concern. Compounds found in and around the mold are: styrene, toluene, benzene, ethyl benzene, methane, ethane, propane, hydrogen, and carbon soot.

The full mold casting process is being used in a growing number of large commercial foundries, casting aluminum and iron. Large foundries are making aluminum automotive inlet manifolds and cylinder heads, and cast iron exhaust manifolds, engine blocks, and other automotive components. Large commercial foundries producing valves, pumps, and pipe fittings are in operation.

At the pouring temperatures of iron and above, vapors of decomposing plastic foam either burns or "cracks" producing much free carbon soot which cannot escape from the mold. Iron is already saturated with carbon, but when cast in the full mold process, hard lustrous carbon deposits or carbon filled pits form on the surfaces of castings. Such defects, called "elephant skin" occur on sections of casting over about 15 mm thick. The direct control of such defects has been to avoid casting sections heavy enough to cause deposits. Polymethyl methacrylate foam has been introduced as an option to polystyrene foam, having the advantage of producing little free carbon upon pyrolysis. Ancillary methods of venting the offending carbon are also employed.

Low carbon steel cannot be successfully cast using the full mold casting process; the advantages of precision casting can be attained only through the substantially slower and more expensive lost wax process.

BRIEF SUMMARY OF THE INVENTION

An object of this invention is to provide a method to produce precision castings of low carbon steel, or of high purity or contaminant sensitive alloy, using a sacrificial polymeric foam pattern.

Another object of this invention is to provide a method of precision casting using a sacrificial polymeric foam pattern without releasing to the environment hazardous compounds associated with pryolyzation of such a pattern.

Yet another object of this invention is to provide a precision casting process for contaminant sensitive metals using a sacrifical polymeric foam pattern, such a process requiring a low capital investment, being comparable to that of other lost foam founderies.

After expanded polystyrene parts or patterns are molded, they undergo dimensional changes over about a 30 day period. When a pattern is built of separately molded pieces of different ages, they may not fit. The freshly molded parts may be stabilized by aging for six hours in the driving kiln. The stabilizing process is preferred as a step in the instant process to eliminate residual blowing agent prior to investing the pattern, and as means of reducing casting tolerances.

A pattern cluster, comprising a suitable pouring cup, and, at least one riser, at least one ingate, and at least one piece-part pattern, made of a polymeric foam material, is conventionally invested for pouring.

The entire investment mold is placed in a drying-/evaporating kiln which is radiantly heated to a temperature which is a little short of initiating melting of the polymeric foam being used. The proper temperature for expanded bead polystryene foam is about 325/375 degrees Fahrenheit. A course vacuum is applied by a roughing pump. At the reduced air pressure within the kiln, and at the temperature of the kiln, water and foam are evaporated, or distilled, from the mold. The foam is reduced to vapor by chain scission, wherein the plastic is disassembled molecule by molecule, instead of by pyrolysis. The byproducts may be collected in a cold trap, or passed through the vacuum pump and subsequently vented or trapped in a suitable solvent wash.

The capacity of the vacuum roughing pump then determines the total time required to eliminate the pattern and the water from the investment mold. The level of vacuum is limited as long as any volatile material exists in the kiln. When the vacuum rises to the normal limits of the roughing pump, then it can be determined that the evaporation is complete.

The last material to vaporize in the kiln is adhesive which may have been used to join pieces of the pattern cluster together. Such adhesive generally has a density about twenty times as great as the foam itself. The investment is processed by conventional methods after the vacuum evaporation process is completed.

Although these are numerous choices of process steps and of materials, some of those choices may be expanded or otherwise influenced by the addition of the new step of vacuum evaporation of the mold prior to pouring. For example, after the pattern has been evaporated, the investment may be fired, as in the lost wax process.

The instant method of evaporating the foam pattern provides a precision casting process with the best advantages of both the full mold process and of the lost wax process, while avoiding major disadvantages of both processes.

The steam autoclave is a capital and maintenance intensive item, required in the lost wax process, and not in the full mold process, or in the instant process.

Gating, risering, and pouring in the instant process is substantially the same as in the lost wax process, and is already familiar to the investment foundryman. These practices as used in the full mold casting process are very different and often troublesome.

Concern about the permeability of the mold and the sand in the full mold process is no longer a problem when the pattern is evaporated from the mold prior to pouring, and the instant process resembles the lost wax process in this regard.

Production of foam patterns is much less time and labor intensive than the production of wax patterns.

The instant invention is directed to the addition of the single step of vacuum evaporation of the sacrificial polymeric foam pattern prior to pouring the metal in a precision casting process.

An advantage of the present invention is that the special proprietary coatings required of the full mold process are not required of the instant process, which may use either a conventional fired shell mold type of investment, or the special proprietary permeable coating already mentioned.

Another advantage of this invention is that no cores are required; no flash is produced so none need be removed; uniformly thin walls save metal and yield stronger and lighter castings; and many useful details may be cast in to save secondary production operations; all because this is a precision casting process.

Yet another advantage of this invention is that tooling for the foam pattern is substantially less expensive than is tooling for a wax pattern, yet can produce about twenty times as many patterns in a given length of time. Pattern tooling will provide true uniformity of patterns, and consequently of castings, over a long period of time because the tooling is not subject to wear in use.

The above noted objects and advantages of the present invention will be more fully understood upon a study of the following description, in conjunction with the appended claims.

DESCRIPTION OF THE PREFERRED EMBODIMENTS AND BEST MODE FOR CARRYING OUT THE INVENTION

The presently preferred embodiment of this invention is a method consisting of the following steps:

A. Assembling a pattern cluster consisting of a suitable pouring cup, and, at least one riser, at least one ingate, and at least one piece-part pattern, made of a polymeric foam.

B. Investing the pattern cluster with a conventional refractory shell mold.

C. Evaporating the pattern cluster from the refractory shell mold, and drying the refractory shell mold, in a low temperature vacuum drying kiln.

D. Firing the refractory shell mold to burn-out any residual volatiles and to vitrify the refractory mold.

E. Pouring the refractory mold with a selected molten metal.

An alternate embodiment uses a solid refractory mold, and consists of the following steps:

A. Assembling a pattern cluster consisting of a suitable pouring cup, and, at least one riser, at least one ingate, and at least one piece-part pattern, made of a polymeric foam.

B. Investing the pattern cluster by applying a single coating of refractory slurry to the pattern cluster, drying the coated pattern cluster in a low temperature kiln, positioning the dried coated cluster in a flask, and packing the flask with a material selected from the group consisting of dry unbonded foundry sand, bonded sand, and investment slurry.

C. Evaporating the pattern cluster from the solid investment mold in a low temperature vacuum kiln.

D. And pouring the solid investment mold with a selected molten metal.

This invention is directed to the additional step of evaporating a sacrificial polymeric foam pattern from the refractory investment mold prior to pouring the molten metal.

The practice of this invention does not intentionally limit the many choices of process steps or of materials available to the investment foundryman, except to specify that the pattern cluster below the pouring cup is to be made of a polymeric foam material which is removed from the refractory investment by vacuum evaporation prior to pouring the molten metal. For example, the solid investment mold described above could as well be fired in a ceramic kiln after the pattern cluster is evaporated out and before the molten metal is poured without deviating from the spirit or intent of the invention herein described and claimed.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

I claim:

1. An environmentally clean method for lost foam casting comprising the steps of:

providing a polymeric foam pattern cluster, investing said pattern cluster in a refractory mold, evaporating said pattern cluster from said refractory mold in a low temperature vacuum kiln, and pouring said refractory mold with a selected molten metal.

2. The invention as described in claim 1 wherein said polymeric pattern cluster is made of expanded polystyrene.

3. The invention as described in claim 1 wherein said polymeric pattern cluster is made of polymethyl methacrylate in an expandable form.

4. The invention as described in claim 1 wherein said refractory mold is fired in a ceramic kiln after said polymeric pattern cluster is evaporated from said refractory mold and prior to pouring said selected molten metal.

5. An environmentally clean method for lost foam casting comprising the steps of:

providing a polymeric foam pattern cluster, investing said polymeric pattern cluster in a refractory shell mold, evaporating said pattern cluster from said refractory shell mold in a low temperature vacuum kiln, and pouring said refractory shell mold with a selected molten metal.

6. The invention as described in claim 5 wherein said polymeric pattern cluster is made of expanded polystyrene.

7. The invention as described in claim 5 wherein said polymeric pattern cluster is made of polymethyl methacrylate in an expandable form.

8. The invention as described in claim 5 wherein said refractory shell mold is fired in a ceramic kiln after said polymeric pattern cluster is evaporated from said refractory mold and prior to pouring said selected molten metal.

9. An environmentally clean method for lost foam casting comprising the steps of:

providing a polymeric pattern cluster comprising: a suitable pouring cup, and, at least one riser, at least one ingate, and at least one piece-part pattern made of a polymeric foam material, investing said polymeric pattern cluster in a single coat of refractory slurry, drying said single coat, positioning said dried coated polymeric pattern cluster within a flask, and packing said flask with a material selected from the group consisting of dry unbonded foundry sand, bonded foundry sand, and investment slurry, thus forming a solid investment mold, evaporating said polymeric pattern cluster from said solid investment mold in a low temperature vacuum kiln, and pouring said solid investment mold with a selected molten metal.

10. The invention as described in claim 9 wherein said polymeric pattern cluster is made of expanded polystyrene.

11. The invention as described in claim 9 wherein said polymeric pattern cluster is made of polymethyl methacrylate in an expandable form.

* * * * *